US010428499B2

(12) United States Patent
Caleffi

(10) Patent No.: US 10,428,499 B2
(45) Date of Patent: Oct. 1, 2019

(54) BACKFLOW PREVENTER FOR WATER DISTRIBUTION INSTALLATIONS

(71) Applicant: CALEFFI S.P.A., Fontaneto d'Agogna (IT)

(72) Inventor: Marco Caleffi, Fontaneto d'Agogna (IT)

(73) Assignee: Caleffi S.p.A. (IT)

( * ) Notice: Subject to any disclaimer, the term of this patent is extended or adjusted under 35 U.S.C. 154(b) by 121 days.

(21) Appl. No.: 15/547,940

(22) PCT Filed: Feb. 9, 2016

(86) PCT No.: PCT/EP2016/052715

§ 371 (c)(1),
(2) Date: Aug. 1, 2017

(87) PCT Pub. No.: WO2016/128393

PCT Pub. Date: Aug. 18, 2016

(65) Prior Publication Data

US 2018/0016775 A1 Jan. 18, 2018

(30) Foreign Application Priority Data

Feb. 10, 2015 (IT) ..... MI2015A0185

(51) Int. Cl.
*E03C 1/10* (2006.01)
*E03B 7/07* (2006.01)

(52) U.S. Cl.
CPC ..... *E03C 1/106* (2013.01); *E03B 7/077* (2013.01)

(58) Field of Classification Search
CPC ..... E03C 1/106; E03B 7/077; F16K 17/00
See application file for complete search history.

(56) References Cited

U.S. PATENT DOCUMENTS 4,991,622 A * 2/1991 Brewer ..... F16K 15/06 137/218
5,813,428 A * 9/1998 Almasy ..... E03B 9/02 137/218

FOREIGN PATENT DOCUMENTS

DE 19827010 A1 1/2000
DE 202009016823 U1 4/2001

(Continued)

*Primary Examiner* — P. Macade Nichols
(74) *Attorney, Agent, or Firm* — Laubscher & Laubscher, P.C.

(57) ABSTRACT

A backflow preventer for water distribution installations includes a body having an inlet conduit arranged along an inlet axis, an outlet conduit arranged along an outlet axis, and a discharge conduit arranged along a discharge axis of the body. The backflow preventer is provided with check valves that prevent a backflow of fluid from the outlet to the inlet in the event of low pressure upstream of the backflow preventer and/or high pressure downstream of the backflow preventer. The backflow preventer further includes a discharge valve arranged along the discharge axis of the body of the backflow preventer for discharging fluid in the low and/or high pressure conditions. A discharge pipe is connected to the discharge valve to discharge the fluid outside the backflow preventer along an end discharging axis of the fluid outside the backflow preventer. Coupling elements are provided to adapt the backflow preventer to various applications for varying the angular position of the discharge pipe with respect to the body of the backflow preventer.

11 Claims, 10 Drawing Sheets

(56) References Cited

FOREIGN PATENT DOCUMENTS

| | | | |
|---|---|---|---|
| DE | 102010021805 | A1 | 6/2011 |
| GB | 2181806 | A | 4/1987 |
| WO | 2008152643 | A2 | 12/2008 |

* cited by examiner

BACKFLOW PREVENTER FOR WATER DISTRIBUTION INSTALLATIONS

This application is a § 371 National Stage Entry of PCT/EP2016/052715 filed Feb. 9, 2016 entitled "Backflow Preventer for Water Distribution Installations." PCT/EP2016/052715 claims priority to IT-MI2015A000185 filed Feb. 10, 2015. The entire contents of these applications are incorporated herein by reference in their entireties.

BACKGROUND OF THE INVENTION

The object of the present invention is a backflow preventer for water distribution installations, intended to perform a water protection function.

State of the Art

The backflow preventer is substantially a safety device that prevents the backflow of contaminated and/or polluted waters into the mains water network of the public water supply.

The backflow preventer is installed between the mains water network and the user network and if there is a drop in pressure in the mains water network with respect to the user network the backflow preventer prevents the backflow of water from the user network to the mains water network.

The drop in pressure in the distribution network can occur following a break in the pipe of the public water supply or following significant withdrawals by other user networks.

The flow reversal condition can also occur not because of a drop in pressure in the mains water network but because of an increase in pressure in the user network that is for example due to the entry of water pumped from a well.

The backflow preventer is usually a valve unit that includes a check valve upstream, a check valve downstream, and a discharge valve in an intermediate reduced pressure area that opens when reversed flow conditions occur, enabling the discharge of the water contained in the intermediate area to the outside through a discharge pipe.

There are very many applicational fields for the backflow preventer in view of the fundamental protective action that it performs. The backflow preventer can be used in heating plants, industrial plants, agricultural plants, hospital plants, irrigation plants and others.

In view of the large variety of applications, the manufacturer of these plumbing devices has to provide a large number of backflow preventer models to adapt to the various geometries that are due to the positioning of the connections on which the backflow preventer is connected in the various applications.

Providing different models of backflow preventer leads to problems for the manufacturer at the manufacturing, at the storage and at the transporting stage and also leads to problems for the retailers and fitters who have to manage these various models of backflow preventer.

Object of the Invention

The object of the present invention is to propose a backflow preventer for water distribution installations that enables the aforesaid problems to be solved.

SHORT DESCRIPTION OF THE DRAWINGS

In order to understand better the invention, a description is set out below of an exemplifying non limiting embodiment thereof, illustrated in the annexed drawings in which.

DETAILED DESCRIPTION OF THE INVENTION

The illustrated backflow preventer, indicated generally with 10, includes a valve body 11 in which conduits are obtained and in which valve components are received.

Figure 3:
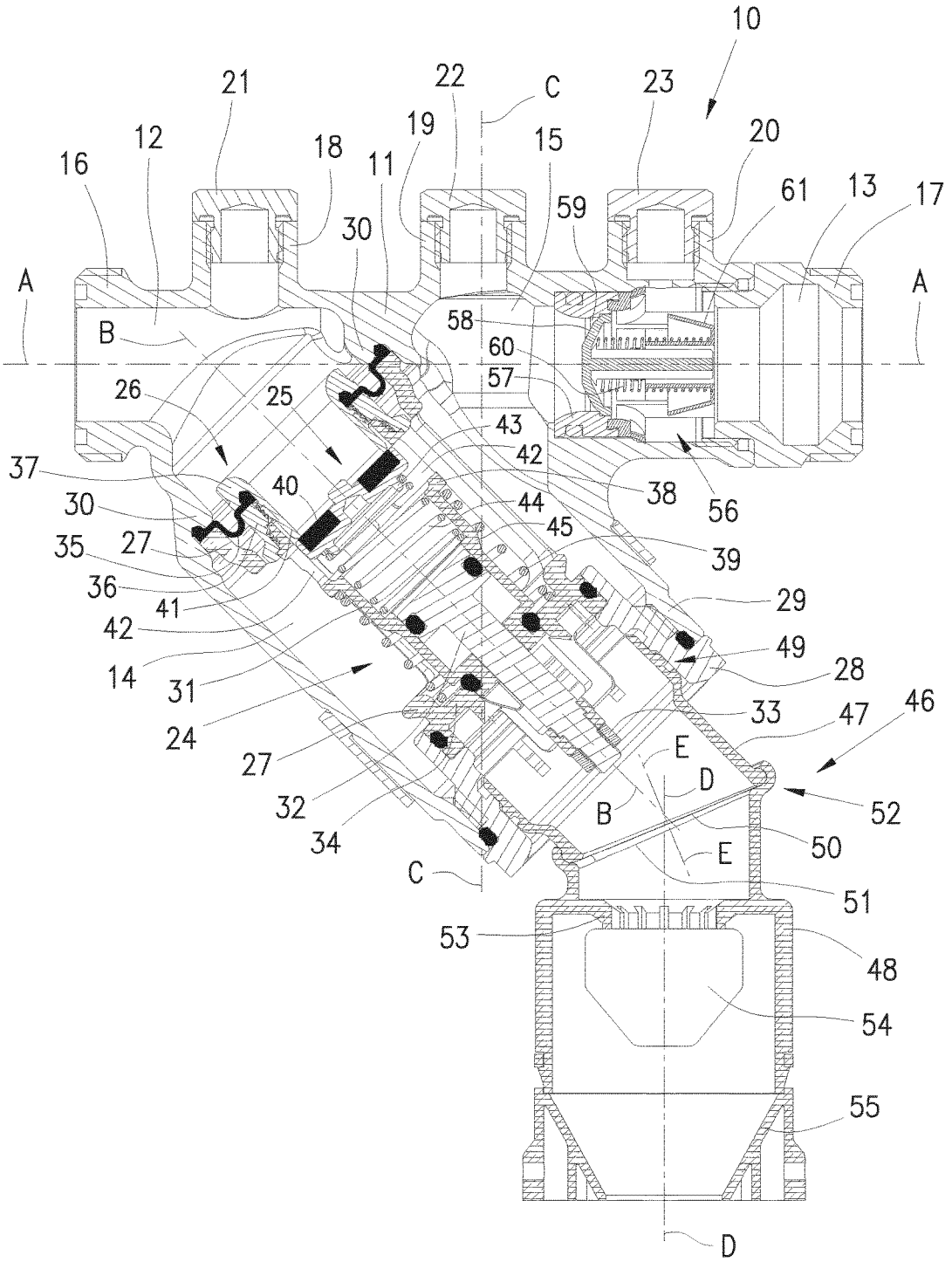
FIG. 3 is an axial section view of the backflow preventer of FIG. 1.

With reference to FIG. 3, in the valve body 11 there are obtained an upstream inlet conduit 12, and a downstream outlet conduit 13, both arranged along the same horizontal axis A. In the body 11 there are further provided an intermediate conduit 14, communicating directly with the inlet conduit 12 and arranged along an axis B that is oblique to the axis A, and another intermediate conduit 15, that brings the intermediate conduit 14 into contact with the outlet conduit 13 and is arranged along an axis C that is perpendicular to the axis A and oblique to the axis B.

The backflow preventer 10 has at the inlet conduit 12 a connection 16 for a water network and at the outlet conduit 13 a connection 17 for a user network.

At the inlet conduit 12, at the intermediate conduit 15, and at the outlet conduit 13 three respective connections 18,19, 20 are provided that are closed by respective caps 21,22,23, to connect pressure gauges when it is necessary to conduct measurements of pressure inside the backflow preventer 10.

Figure 4:
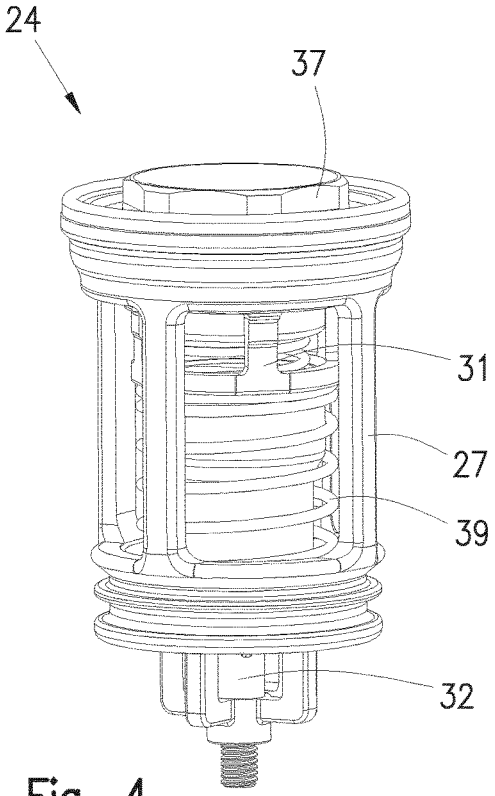
FIGS. 4,5 are respectively a perspective view and an axial section view of a component of the backflow preventer of FIG. 1.
Figure 5:
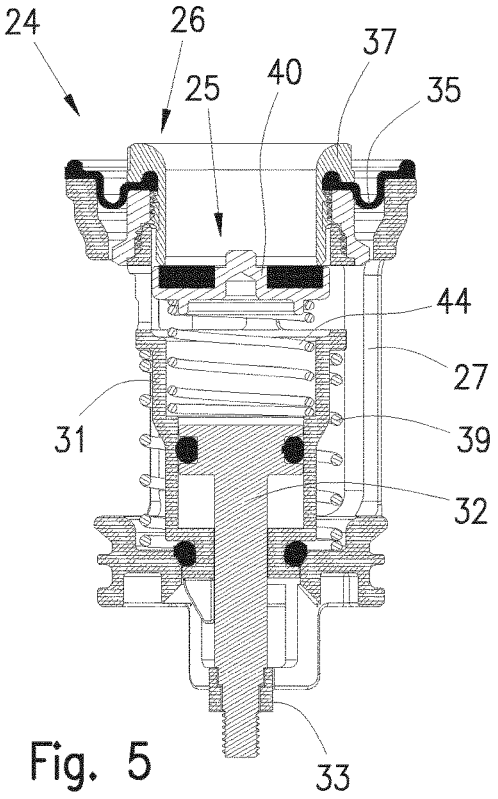

Inside the intermediate conduit 14, which has a larger diameter than the other conduits, a cylindrical valve cartridge 24 is received, illustrated individually in FIGS. 4, 5, which includes a check valve 25 and a diaphragm discharge valve 26 that are both arranged along the axis B.

With reference to FIGS. 3,4,5, the valve cartridge 24 includes a cage 27 inside which the valves 25 and 26 are arranged. The cage 27 is fixed inside the conduit 14 by a threaded bush 28 that is screwed in an open threaded part 29 of the body 11 of the backflow preventer 10 at the conduit 14. The bush 28 locks the cage 27 against an annular seat 30 inside the body 11 of the backflow preventer 10.

The diaphragm discharge valve 26 has a hollow shutter cylinder 31 that is slidable on a piston 32 that is fixed at one end to the cage 27 of the cartridge 24 by a nut 33. One end of the shutter cylinder 31 interacts with an annular seat 34 of the cage 27 to open or close a passage to the inside of the bush 28 according to the position of the shutter cylinder 31. To the opposite end of the shutter cylinder 31 an annular diaphragm 35 is fixed by a ring 36 and a ring nut 37 between which the inner edge of the diaphragm 35 is interposed. The ring 36 is screwed onto the end of the shutter cylinder 31 and the ring nut 37 is screwed onto the ring 36. The outer edge of the diaphragm 35 is locked between the cage 27 and the annular seat 30 of the body 11 of the backflow preventer 10. On an annular seat 38 of the shutter cylinder 31 a coil spring 39 acts in the opening direction that reacts on the annular seat 34 of the cage 27.

The check valve 25 has a shutter 40 that is movable inside the shutter cylinder 31 and interacts with an annular edge 41 of the ring nut 37 for opening or closing the passage through the ring nut 37. The shutter 40 is at side openings 42 of the shutter cylinder 31. On an annular seat 43 of the shutter 40 a coil spring 44 acts in the closing direction that reacts on an annular seat 45 of the shutter cylinder 31.

Figure 6:
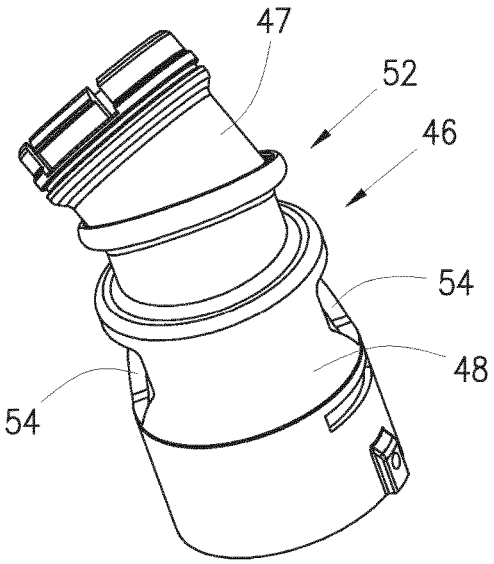
FIGS. 6,7 are respectively a perspective view and a perspective view in a partial section of another component of the backflow preventer of FIG. 1 in an operating configuration.
Figure 7:
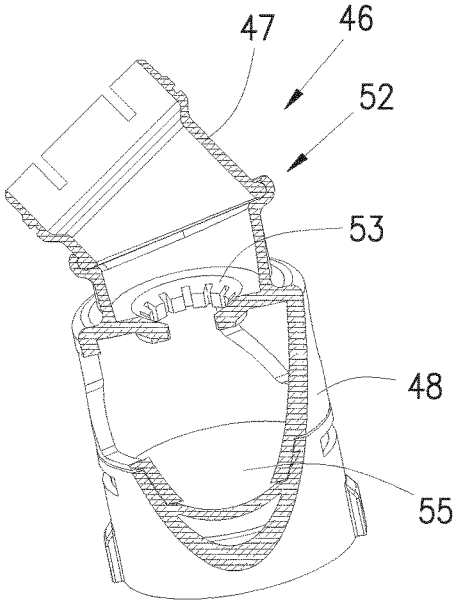

With reference to FIGS. 3,6,7, a discharge pipe 46 is fixed to bush 28 and is formed by a joint portion 47 and an outlet portion 48, which are both cylindrical. The joint portion 47 is directed along the axis B and is fixed to the bush 28 via a snap coupling 49 that retains the portion 47 in the bush 28, permitting rotation thereof with respect to the bush around the axis B. The joint portion 47 further has an outlet connection mouth 50, which is tilted with respect to the axis B. Likewise, the outlet portion 48 has an inlet connection mouth 51, which is tilted with respect to the axis D thereof. The two mouths 50 and 51 are connected via a snap coupling 52 that retains the end portion 48 on the joint portion 47 permitting rotation with respect to the portion 47 around a common axis indicated with E. Both mouths 50 and 51 have the same tilt with respect to the axes B and D of the respective portions 47 and 48, and this tilt has a value of ¾ of a right angle. The outlet portion 48 has a shaped conveying part 53, side safety discharge windows 54, and a funnel end part 55.

In the outlet conduit 13 another check valve is located that is indicated generically with 56. The valve 56 provides a cage body 57 in which a shutter 58 is movable that interacts with a seat 59 of the body 57 to open or close the passage along the conduit 13. On the shutter 58 a spring 60 acts in a closing direction that reacts on an annular inner seat 61 of the body 57.

Figure 8:
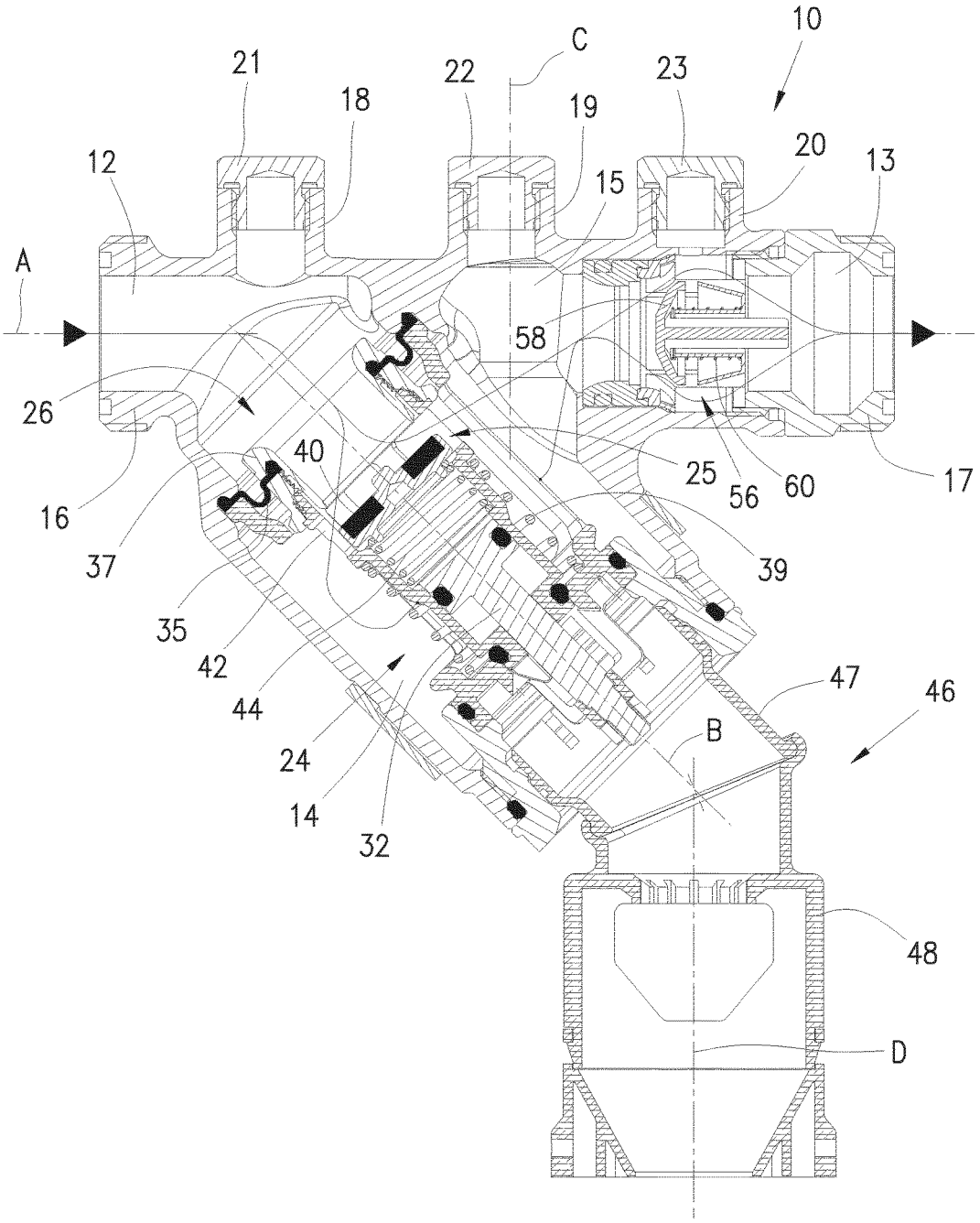
FIGS. 8,9,10 show the operation of the backflow preventer of FIG. 1 in the axial section view of FIG. 3.
Figure 9:
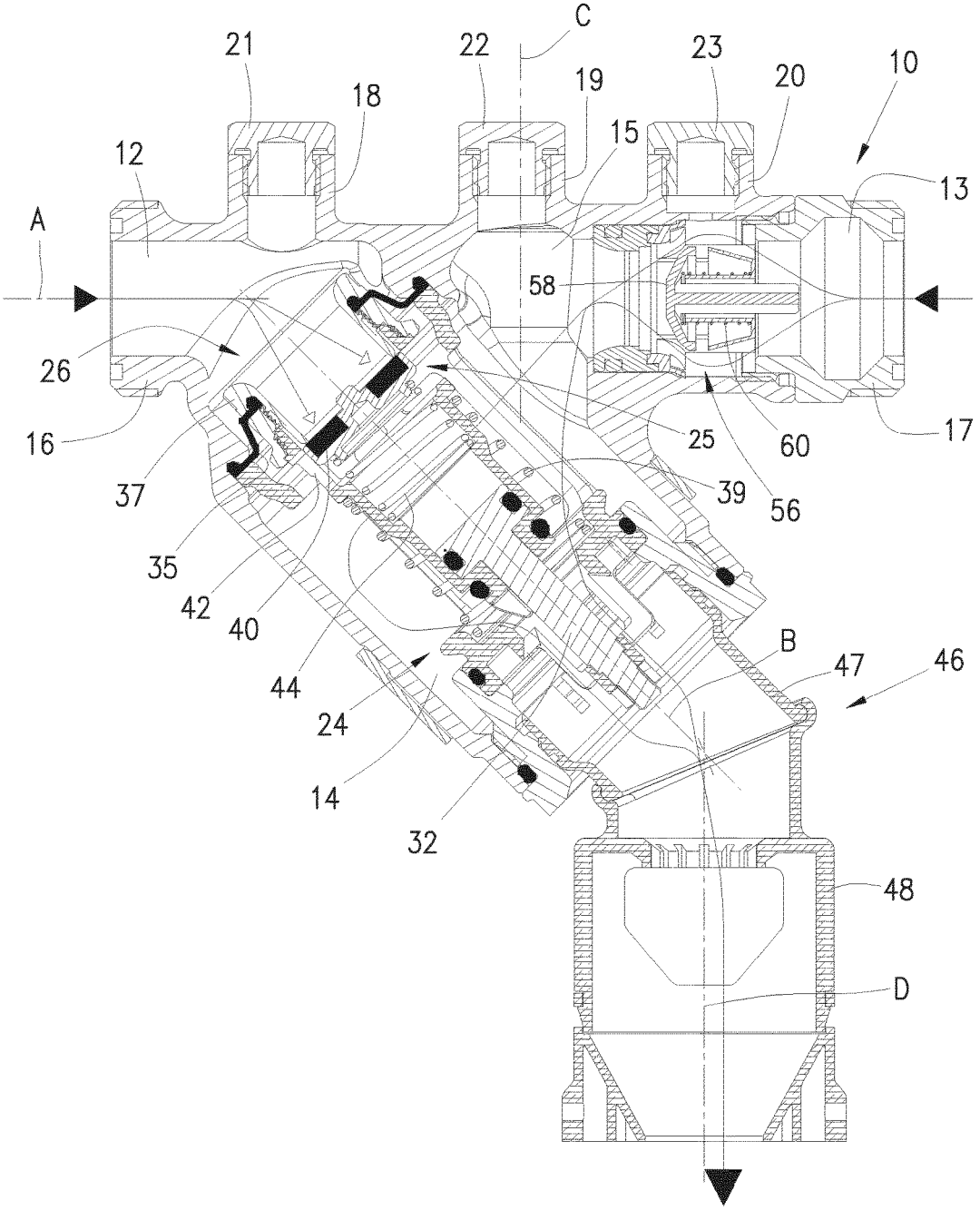
Figure 10:
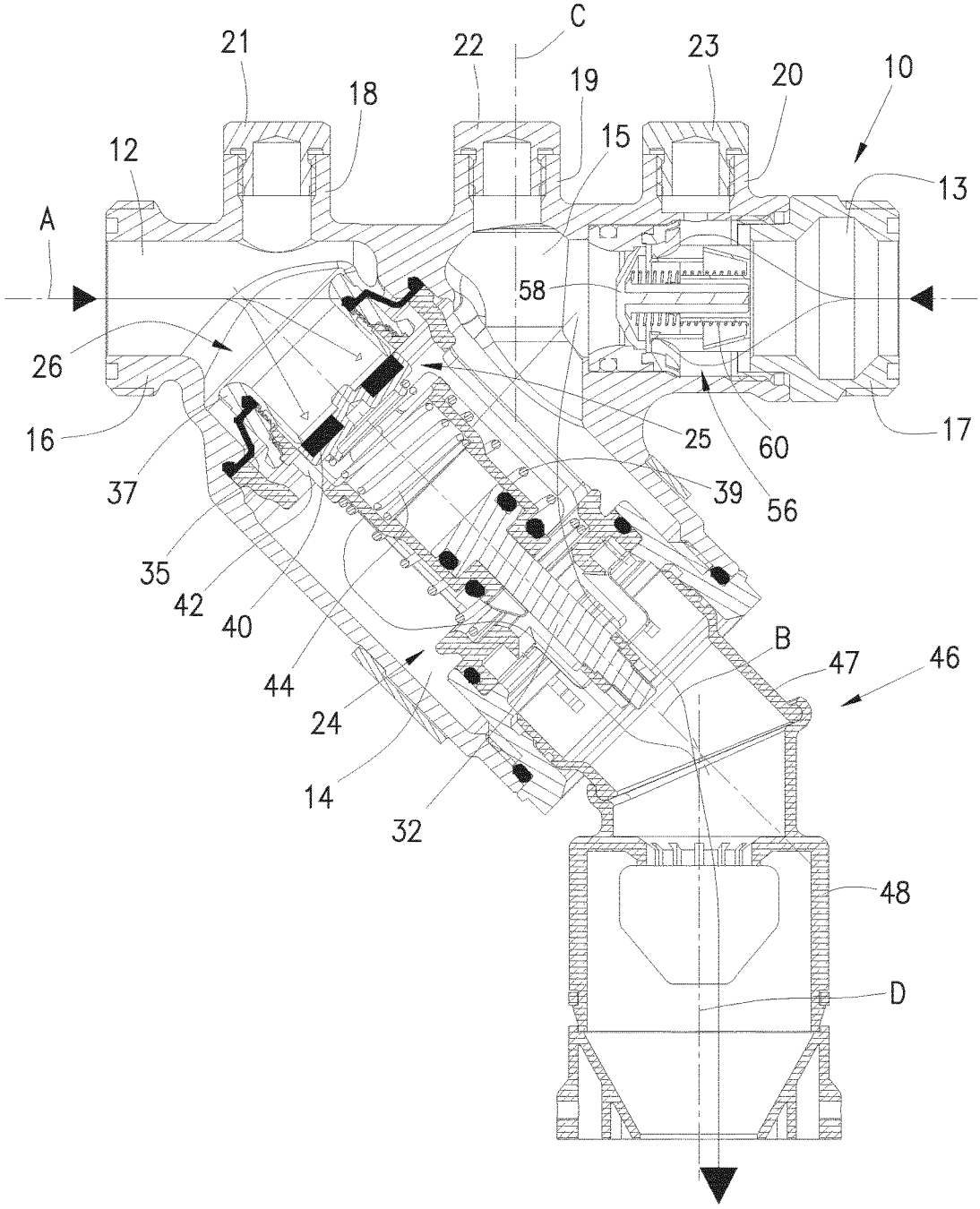
Figure 11:
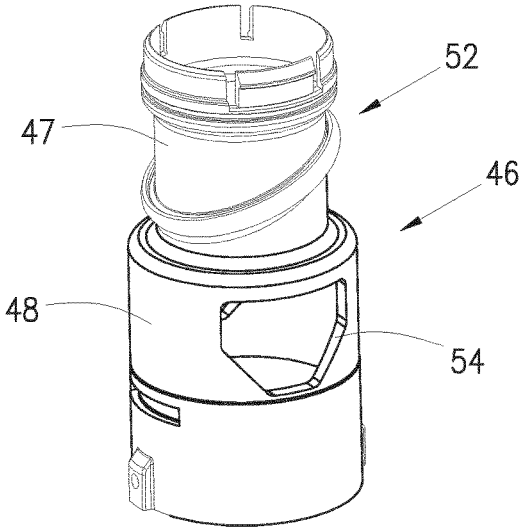
FIGS. 11,12,13 show respectively in a perspective view, in an elevation view, and in a section view according to line 13-13 of FIG. 12 the component of FIGS. 6,7 in another operating configuration.
Figure 12:
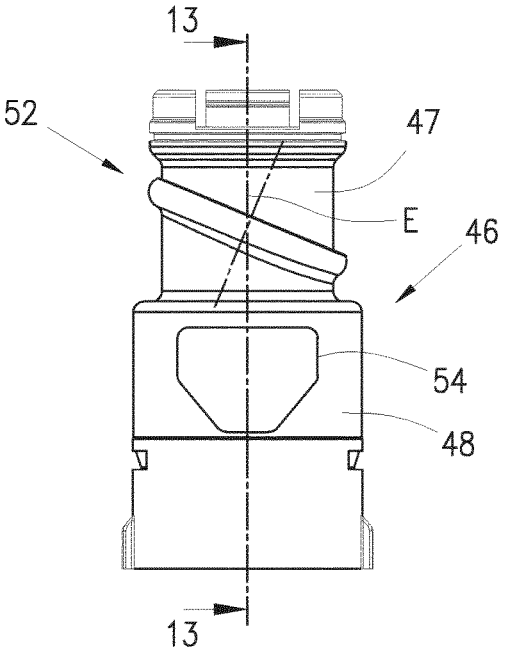
Figure 13:
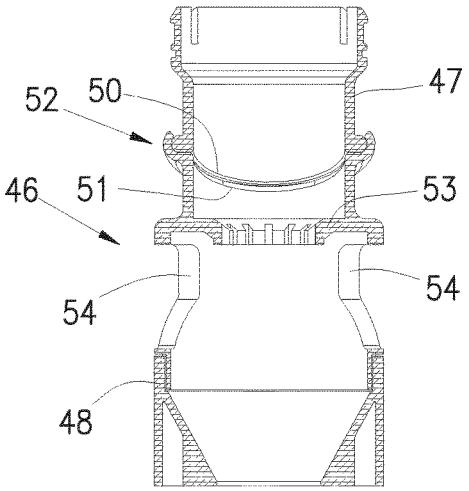
Figure 14:
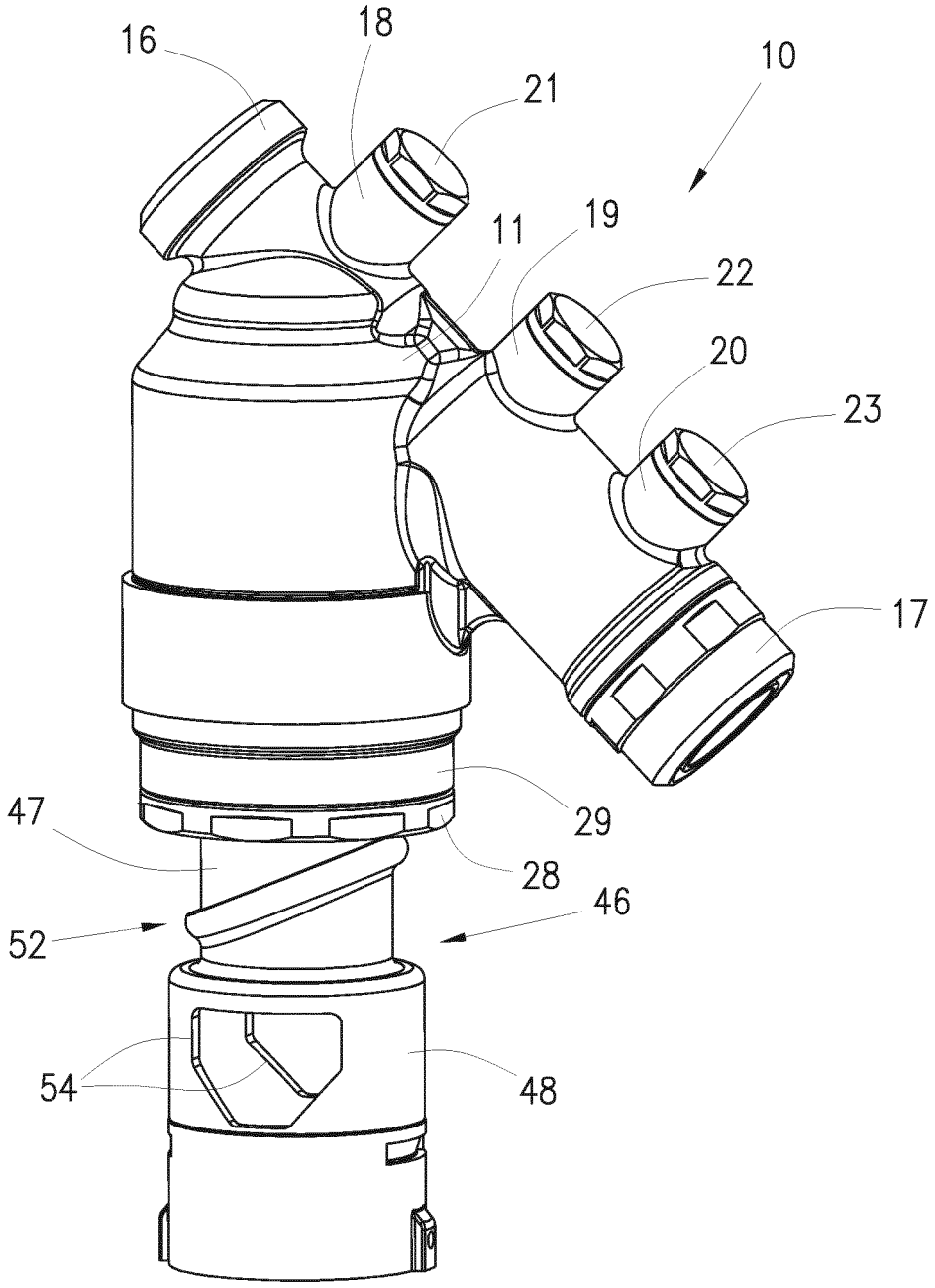
FIG. 14 shows in a perspective view the backflow preventer of FIG. 1 with the component of FIGS. 6,7 in the operating configuration of FIGS. 11,12,13.

With reference to FIGS. 8,9,10 the operation of the backflow preventer 10 is as follows.

In this example it is supposed that the backflow preventer 10 is connected, in a water distribution installation, between a public mains water connection via the connection 16 and a private user network via the connection 17.

The conduit 12 defines an inlet area, the intermediate conduits 14,15 define an intermediate reduced pressure area, and the conduit 13 defines an outlet area.

In a correct flow condition, illustrated in FIG. 8, the check valves 26 and 56 are open and thus the shutters 40 and 58 are open to contrast the action of the respective springs 44 and 60. The water flows in the backflow preventer 10 from the water network to the user network via the conduit 12, the ring nut 37, the windows 42, the conduit 14, the conduit 15 and the conduit 13, as indicated by the arrows. The pressure in the intermediate area is less than the inlet pressure by the effect of the load loss caused by the check valve 25. In this situation the pressure acting upstream on the diaphragm 35 and on the shutter cylinder 31 is greater than the force exerted by the spring 39 on the shutter cylinder 31 and thus the discharge valve 26 remains shut.

If the flow is stopped, the check valves 26 and 56 and thus the shutters 40 and 58 close by the action of the springs 44 and 60. The pressure in the intermediate area is still less than the inlet pressure and the discharge valve 26 remains shut.

With reference to FIGS. 9,10, in a flow condition, if the pressure in the inlet area decreases both the check valves 26 and 56 close. The discharge valve 26 opens at the moment in which the upstream pressure on the diaphragm 35 and on the shutter cylinder 31 is lower than the force exerted on the shutter cylinder by the spring 39. At this point the shutter cylinder 31 lifts up by the action of the spring 39 to let the water contained in the intermediate area flowing to the discharge pipe 46, where it flows through the portions 47 and 48 and then exits the pipe as indicated by the arrows.

If the pressure in the outlet area rises above the value of the pressure in the inlet area, the check valve 56 closes, thus not permitting the backflow to the water network of the water already sent to the user network. If the check valve 56 had a seal defect and the water leaked into the intermediate area the check valve 25 would prevent any backflow of water to the water network. A pressure increase in the intermediate area would then cause the discharge valve 26 to open, as seen above.

The backflow preventer 10 thus performs the protective function mentioned in the introduction.

The particular coupling seen between the portion 47 and the portion 48 of the discharge pipe 46 enables the geometry of the discharge pipe to be varied. In fact, the rotation on tilted faces of the portion 48 with respect to the portion 47 around the axis E enables the axis D of the portion 48 to be rotated with respect to the axis B of the portion 47 and the angular position of the portion 48 to be thus varied with respect to the portion 47. In particular, by rotating the portion 48 with respect to the portion 47 by 180° from the position illustrated in FIGS. 1,2,6,7,8,9,10 an alignment position is reached of the axis D with respect to the axis B in which the discharge pipe 46 is no longer angled but rectilinear, as illustrated in FIGS. 11-14; in this operating configuration the inlet/outlet axis of the disconnector 10 is tilted with respect to the horizontal lying of FIG. 1.

Figure 1:
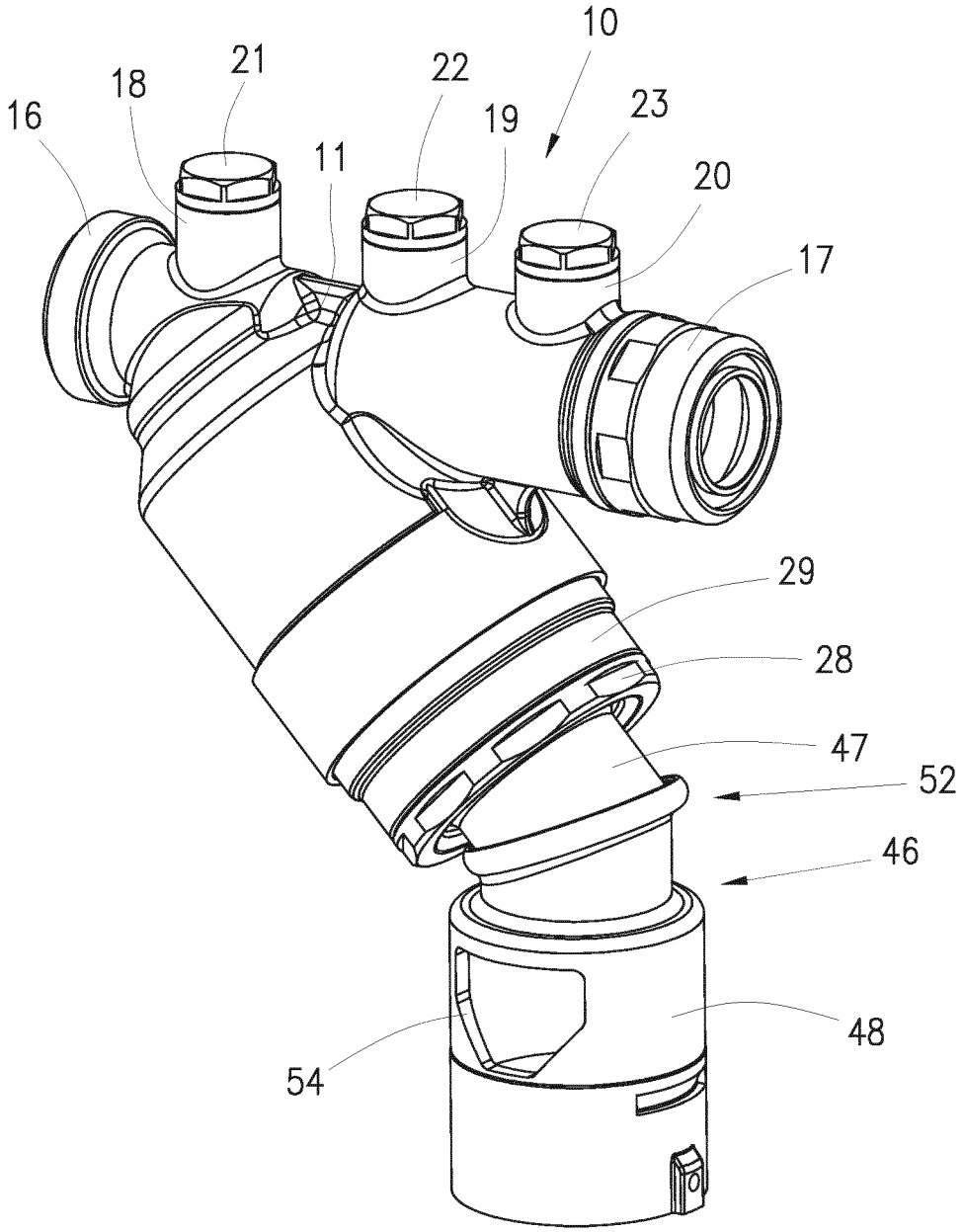
FIG. 1 is a perspective view of a backflow preventer for water distribution installations according to the invention.
Figure 2:
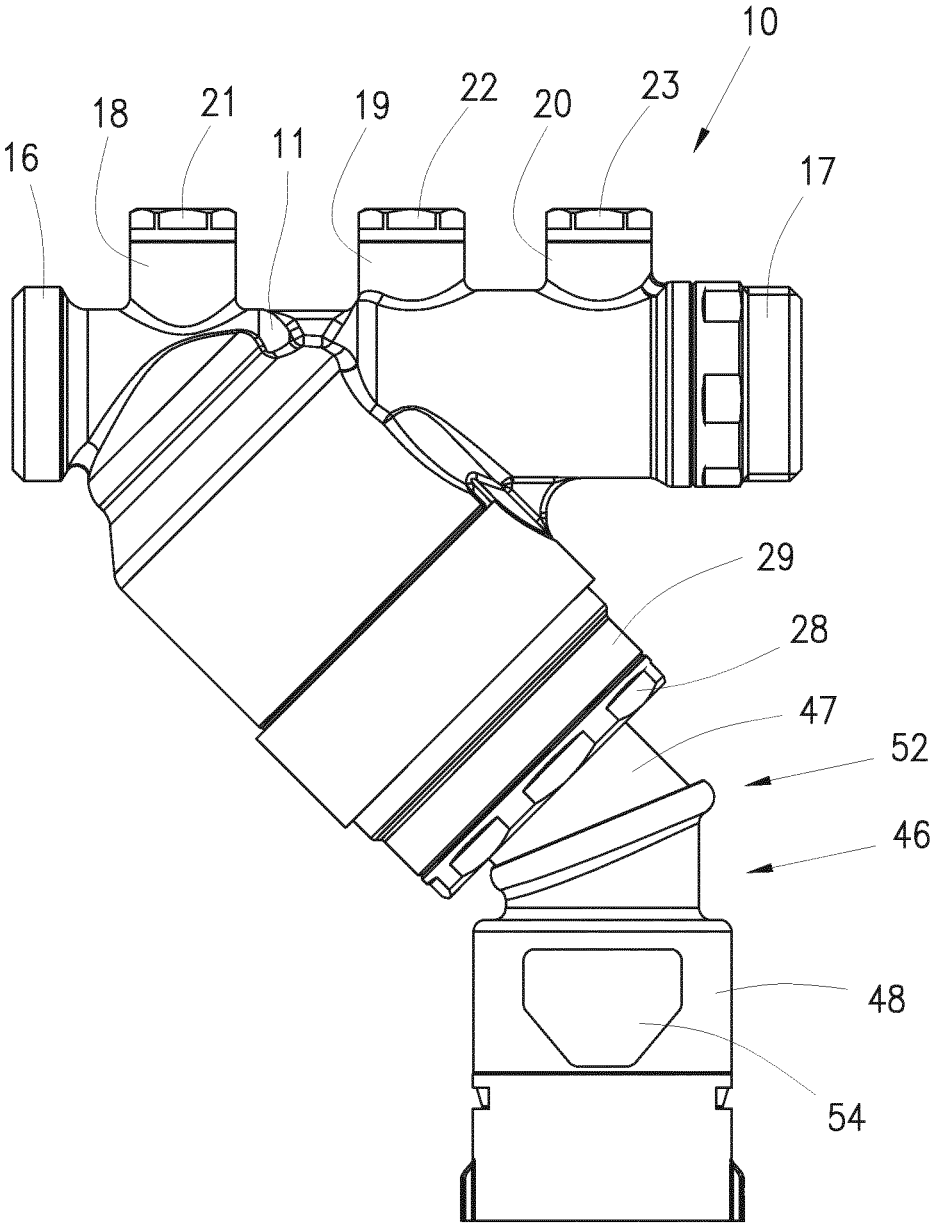
FIG. 2 is a side view of the backflow preventer of FIG. 1.
Figure 15:
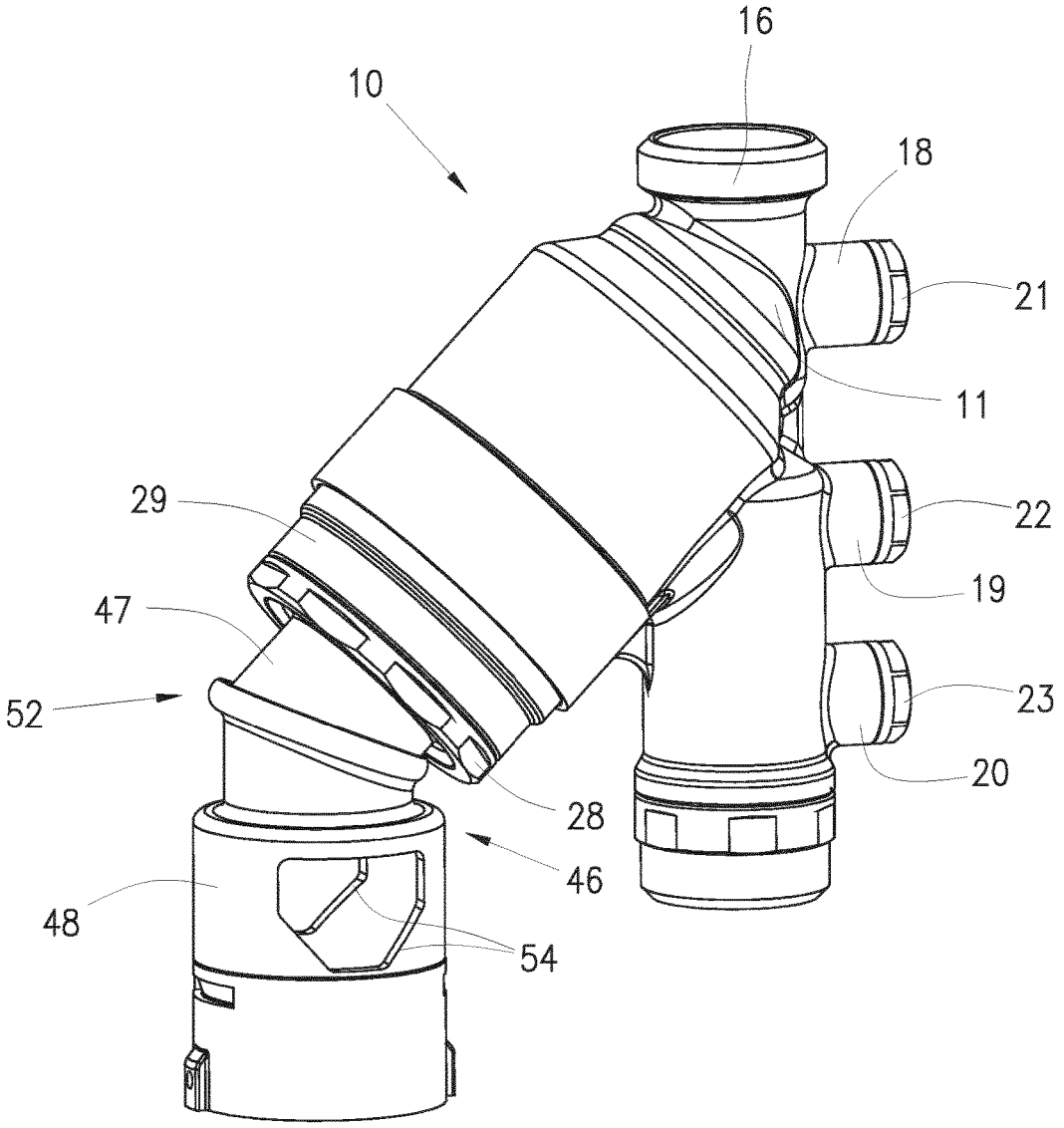
FIG. 15 shows in a perspective view the backflow preventer of FIG. 1 in a further operating configuration.

In FIG. 15 there is another operating configuration of the backflow preventer 10 that is obtained by rotating by 180° the portion 47 with respect to the bush 28, starting from the angled position of the discharge pipe 46 of FIG. 1; in this case the discharge pipe 46 is angled in an opposite direction to what is illustrated in FIG. 1 and the inlet/outlet axis is vertical.

The backflow preventer 10 can thus be adapted to the various geometries required due to the positioning of the connections to which the backflow preventer connects in the various applications. Having to use various backflow preventer models is thus avoided, the variable geometry backflow preventer 10 being sufficient.

The cartridge 24 that incorporates the check valve 25 and the discharge valve 26 incorporates the two functions of retaining and discharging in a single component. Further, the coaxial arrangement of the check valve 25 and of the discharge valve 26 makes the cartridge 24 very compact. Replacing the cartridge 24 is very simple, inasmuch as it is sufficient to unscrew the bush 28, remove the cartridge to be replaced, insert the new cartridge and retighten the bush 28. This replacement is made possible by the use of a diaphragm discharge valve, namely the valve 26, and permits simple maintenance of the backflow preventer 10, leaving the body 11 installed in the water distribution installation.

The connections 18,19,20, once the respective caps 21,22, 23 have been removed, enable pressure gauges to be inserted, as indicated above, to check correct operation of the various areas of the backflow preventer 10.

It is clear that variations on and/or additions to what has been disclosed and illustrated can be foreseen.

In general, it is possible to provide any coupling between the valve body and the discharge pipe to vary the angle between the discharge direction in the valve body, in the embodiment seen above along the axis B, and the discharge direction of the discharge pipe, in the example along the axis D. For example, the discharge pipe can be rectilinear and have a spherical sealing coupling with the valve body.

Variants in the configuration of all the components and conduits obtained in the body can be provided, which are disclosed and illustrated in the embodiment.

The invention claimed is:

1. A backflow preventer for water distribution installations, comprises a body including at least one inlet conduit arranged along an inlet axis, at least one outlet conduit arranged along an outlet axis, and at least one discharge conduit arranged along a first discharge axis of the body, at least one check valve which prevents a backflow of fluid from the outlet conduit to the inlet conduit in the event of a low pressure upstream of the backflow preventer and/or high pressure downstream of the backflow preventer, a discharge valve arranged along the fit discharge axis of the body of the backflow preventer for discharging fluid in the aforesaid low and/or high pressure conditions, a discharge pipe connected with said discharge valve to discharge the fluid outside the backflow preventer along a second discharge axis of the discharge pipe, and a first coupling device for varying an angular position of the discharge pipe with respect to the body of the backflow preventer, said discharge pipe including a first tube portion connected with the body and arranged along the first discharge axis of the body and a second tube portion arranged along the second discharge axis of the discharge pipe, the two pipe portions being connected via two respective joining ports that are angled with respect to their respective axes and via a second coupling that retains the second tube portion on the first tube portion and enables the second tube portion to rotate with respect to the first tube portion.

2. The backflow preventer as defined in claim 1, wherein the angle of each port with respect to the axis thereof has a value of ¾ of a right angle.

3. The backflow preventer as defined in claim 1, wherein in the rotation of the second tube portion with respect to the first tube portion, the first and second discharge axes vary between an angulation position and an alignment position.

4. The backflow preventer as defined in to claim 1, wherein the first tube portion is connected with the body via a coupling that retains the first tube portion on the body and permits rotation of the first tube portion with respect to the body.

5. The backflow preventer as defined in claim 1, wherein the inlet axis and the outlet axis coincide.

6. The backflow preventer as defined in claim 1, wherein the first discharge axis of the body is oblique with respect to the inlet axis and with respect to the outlet axis.

7. The backflow preventer as defined in claim 1, wherein the check valve comprises a first check valve at the inlet of the body of the backflow preventer and a second check valve at the outlet of the body of the backflow preventer, and the discharge valve comprises a discharge valve which is arranged coaxially with respect to the first check valve.

8. The backflow preventer as defined in claim 7, wherein the first check valve is arranged inside the discharge valve.

9. The backflow preventer as defined in claim 7, wherein the first check valve and the discharge valve are incorporated into a valve cartridge removably arranged inside the body of the backflow preventer.

10. The backflow preventer as defined in claim 1, wherein the discharge valve is a diaphragm valve.

11. The backflow preventer as defined in claim 10, wherein an outer edge of the diaphragm valve is locked between a cage of the valve cartridge and an annular seat of the body of the backflow preventer.

* * * * *